US006826853B1

(12) United States Patent
Zanatta

(10) Patent No.: US 6,826,853 B1
(45) Date of Patent: Dec. 7, 2004

(54) SPORTS SHOE PARTICULARLY FOR MOTOCROSS

(75) Inventor: Ivo Zanatta, Montebelluna (IT)

(73) Assignee: Jolly Scarpe, Montebelluna (IT)

( * ) Notice: Subject to any disclaimer, the term of this patent is extended or adjusted under 35 U.S.C. 154(b) by 0 days.

(21) Appl. No.: 10/627,697

(22) Filed: Jul. 28, 2003

(30) Foreign Application Priority Data

Sep. 16, 2002 (IT) ..... TV2002A0106

(51) Int. Cl.[7] ..... A43B 5/04
(52) U.S. Cl. ..... 36/131; 36/118.2; 36/89
(58) Field of Search ..... 36/131, 88, 89, 36/117.1, 118.2, 118.3

(56) References Cited

U.S. PATENT DOCUMENTS 4,563,825 A * 1/1986 Tesser ..... 36/131
5,381,613 A * 1/1995 Pozzobon et al. ..... 36/118.9
5,722,187 A * 3/1998 Pamio et al. ..... 36/88
5,778,566 A * 7/1998 Edauw et al. ..... 36/117.1
6,076,287 A * 6/2000 Savard ..... 36/118.2
6,079,128 A * 6/2000 Hoshizaki et al. ..... 36/89
6,098,317 A * 8/2000 Lazzaroni ..... 36/118.2
RE37,319 E * 8/2001 Meiselman ..... 36/88
6,779,283 B2 * 8/2004 Gabrielli ..... 36/89

FOREIGN PATENT DOCUMENTS

| | | |
|---|---|---|
| EP | 0 724 851 | 8/1996 |
| EP | 0 857 501 | 8/1998 |
| WO | 00 10415 | 3/2000 |

* cited by examiner

*Primary Examiner*—M. D. Patterson
(74) *Attorney, Agent, or Firm*—Guido Modiano; Albert Josif; Daniel O'Byrne

(57) ABSTRACT

A sports shoe, comprising a soft upper provided with a cuff and with a rear counter which are semirigid and are separately connected to the upper, an additional semirigid element that is associated with the upper or monolithically coupled thereto, in an intermediate region, between the cuff and the counter, the additional semirigid element having, at the rear and/or laterally, at least one first tab and at least one second tab for sliding engagement in first guides formed in the cuff and in the counter.

11 Claims, 6 Drawing Sheets

SPORTS SHOE PARTICULARLY FOR MOTOCROSS

BACKGROUND OF THE INVENTION

The present invention relates to a sports shoe, particularly for motocross.

As an overview of the various problems related to sports footwear, it is noted that currently it is known to manufacture sports shoes, such as for example skating shoes, which are constituted by a rigid shell, which is adapted to contain a soft innerboot for the user's foot and to which a likewise rigid quarter is articulated by means of studs, rivets or other fastening systems arranged at the malleolar region.

Such known types of sports shoe therefore have two rigid components that are mutually articulated in order to allow the flexing of the leg with respect to the foot, the rigidity of the shell and of the quarter allowing the transmission of forces.

However, these known types of sports shoe, while having the above-mentioned advantages, also have drawbacks.

For example, in skiing the knee is very active in transmitting forces, while the ankle remains very static within the relatively rigid structure constituted by the shell and the quarter, which are in any case articulated in a point that is adjacent to the malleolar region.

In dynamic terms, this is correct; however, in terms of fit it is not possible to achieve for all users an optimum placement of the seats for the malleoli due to the preset articulation point constituted by the studs.

In skating, the ankle has a much more active role in force generation: the consequent static condition of the ankle is a disadvantage, but the ankle must be protected against the torques that might be generated during practice of the sport on the part of less expert skaters.

The current structure of the shoe for the skate is very similar to the structure of a ski boot and protects the ankle excellently against torques, but it prevents the application of maximum efficiency in the movements that allow advanced sports practice.

For this purpose, it is known that expert speed skaters and roller- and ice-hockey players wear skating shoes that are provided with a soft leather shoe that leaves the ankles free to work by controlled yielding.

U.S. Pat. No. 5,778,566 is also known as a partial solution to the above-mentioned drawbacks and relates to a sports shoe that can be used to perform several sports, such as roller skating and in-line skating, ice skating, hockey, ski-mountaineering, cross-country skiing, snowboarding, basketball or gymnastics.

This shoe comprises a soft innerboot that has a cuff that partially wraps around the leg of the user and with which a semirigid collar is advantageously associated.

Such collar is provided laterally with guiding seats for tabs that protrude from a semirigid body, which is monolithically coupled to the innerboot proximate to the heel and is engaged with the collar at the rear.

Differently from the preceding known types of shoe, in the resulting shoe the lack of rivets or studs at the malleolar region and most of all the free connection in that point between the tabs and the collar allows the foot of the user to perform both a controlled longitudinal movement with respect to the shoe and a lateral movement of controlled extent with respect to the shoe.

Although this solution eliminates several drawbacks that recur in known types of shoe, it has the main drawback of allowing the foot of the user to perform an excessively limited flexing motion, particularly in situations that require considerable combined rotary and translational motions on the part of the foot-ankle system in order to achieve its most appropriate relative arrangements, such as for example in the case of shoes for motorcycling, motocross and racing.

Another drawback that can be observed in this type of known solution is that the resulting shoe has a substantially non-optimum ratio between longitudinal and lateral rigidity and yielding.

SUMMARY OF THE INVENTION

The aim of the present invention is to solve the above-noted problems, eliminating the drawbacks of the cited prior art, by providing a sports shoe that allows to utilize a plurality of degrees of freedom to move the foot while keeping the foot, together with the ankle, effectively supported and protected, particularly for shoes for motorcycling.

Within this aim, an object of the invention is to provide a shoe that is particularly comfortable and adaptable to the various shapes of the foot, particularly as regards the portion of the shoe that is designed to make direct contact with the malleoli.

Another object is to provide a sports shoe that has an optimum ratio between longitudinal and lateral rigidity and yielding, in order to achieve optimum performance even at a non-advanced user level.

A further object is to provide, together with the characteristics noted above, a shoe whose rigidity allows optimum protection of the foot of the user against any torques generated during sports practice.

A still further object is to provide a shoe that is reliable and safe in use, can be obtained with low manufacturing costs and can be manufactured with conventional and known machines and equipment.

This aim and these and other objects that will become better apparent hereinafter are achieved by a sports shoe, particularly for motocross, which comprises a soft upper that is provided with a cuff and with a rear counter which are semirigid and are separately connected to said upper, characterized in that it comprises an additional semirigid element that is connected to said upper in an intermediate region between said quarter and said counter, said additional semirigid element being provided, at the rear and/or laterally, with at least one first tab and at least one second tab for sliding engagement in guiding means formed in said quarter and said counter.

BRIEF DESCRIPTION OF THE DRAWINGS

Further characteristics and advantages of the invention will become better apparent from the following detailed description of a particular embodiment thereof, illustrated by way of non-limitative example in the accompanying drawings, wherein.

DESCRIPTION OF THE PREFERRED EMBODIMENTS

Figure 1:
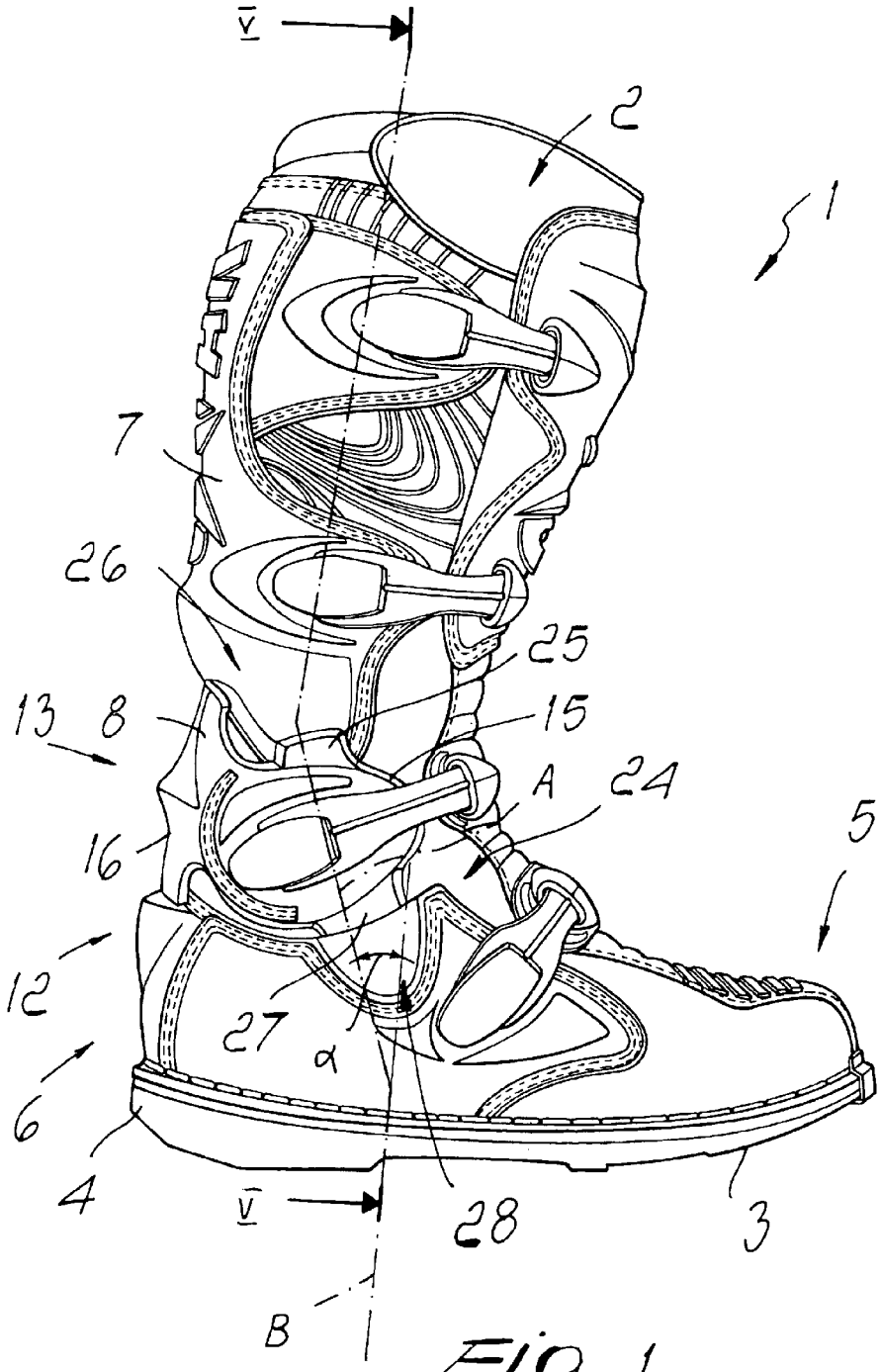
FIG. 1 is a first side view of the invention.
Figure 2:
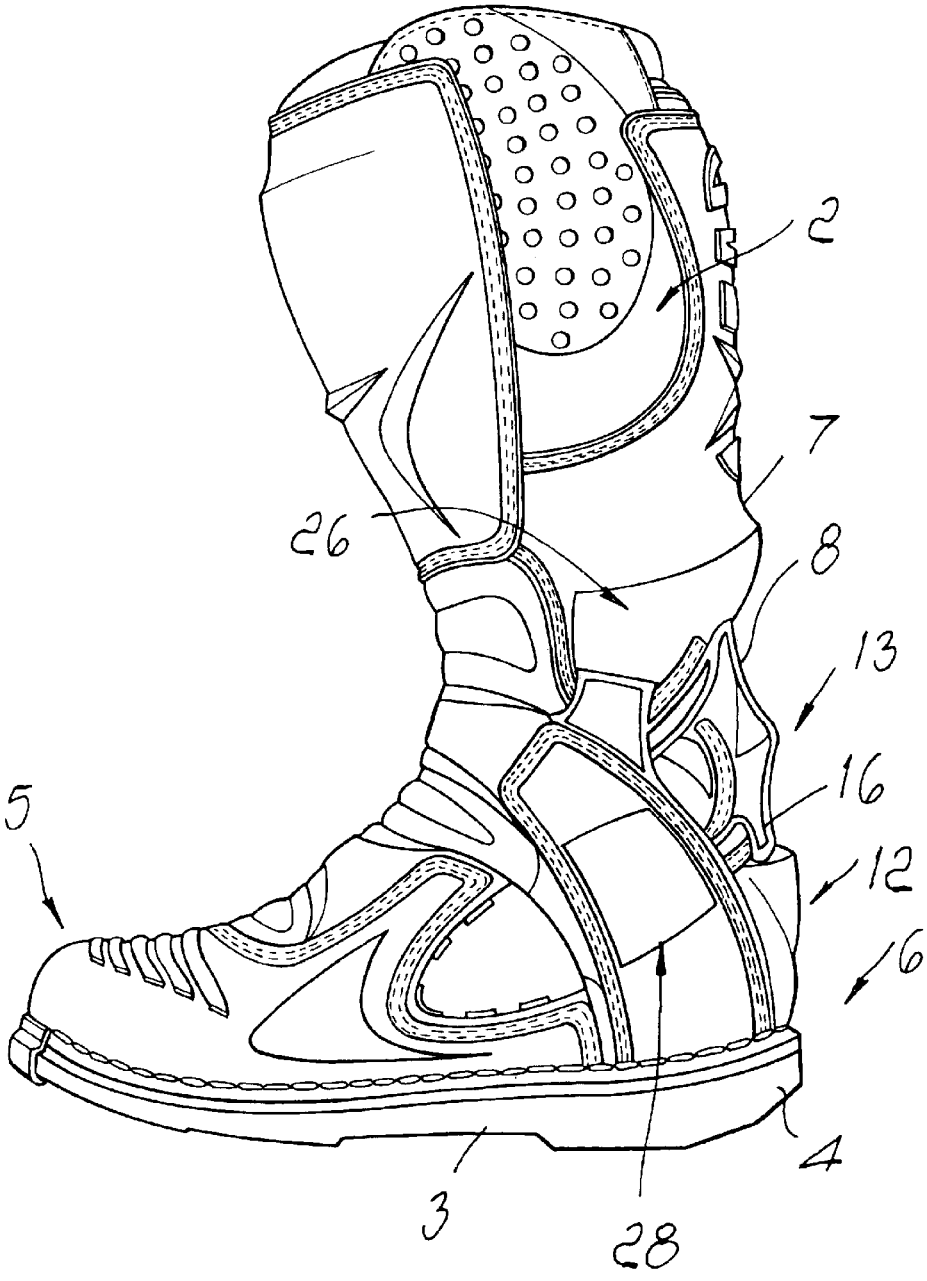
FIG. 2 is a second side view of the invention.
Figure 3:
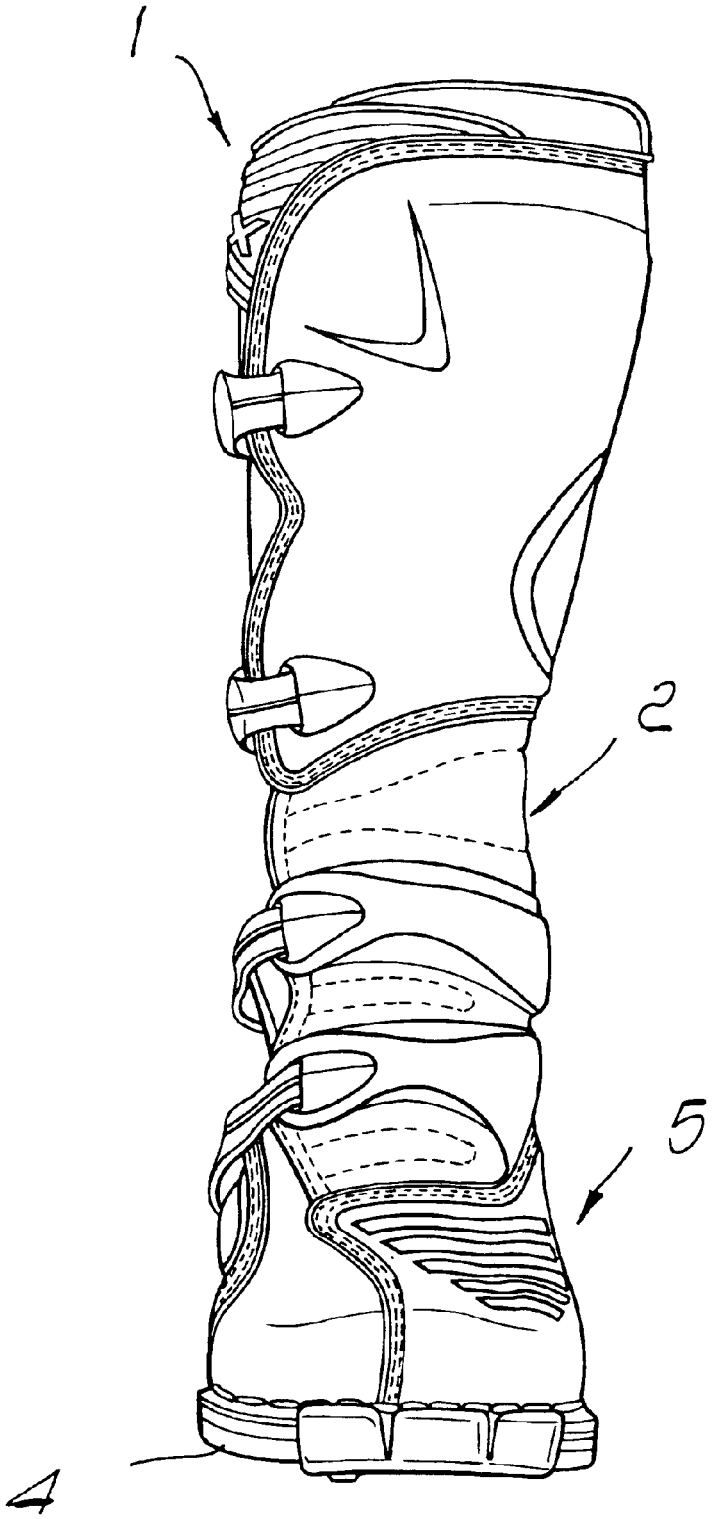
FIG. 3 is a front view of the invention.
Figure 4:
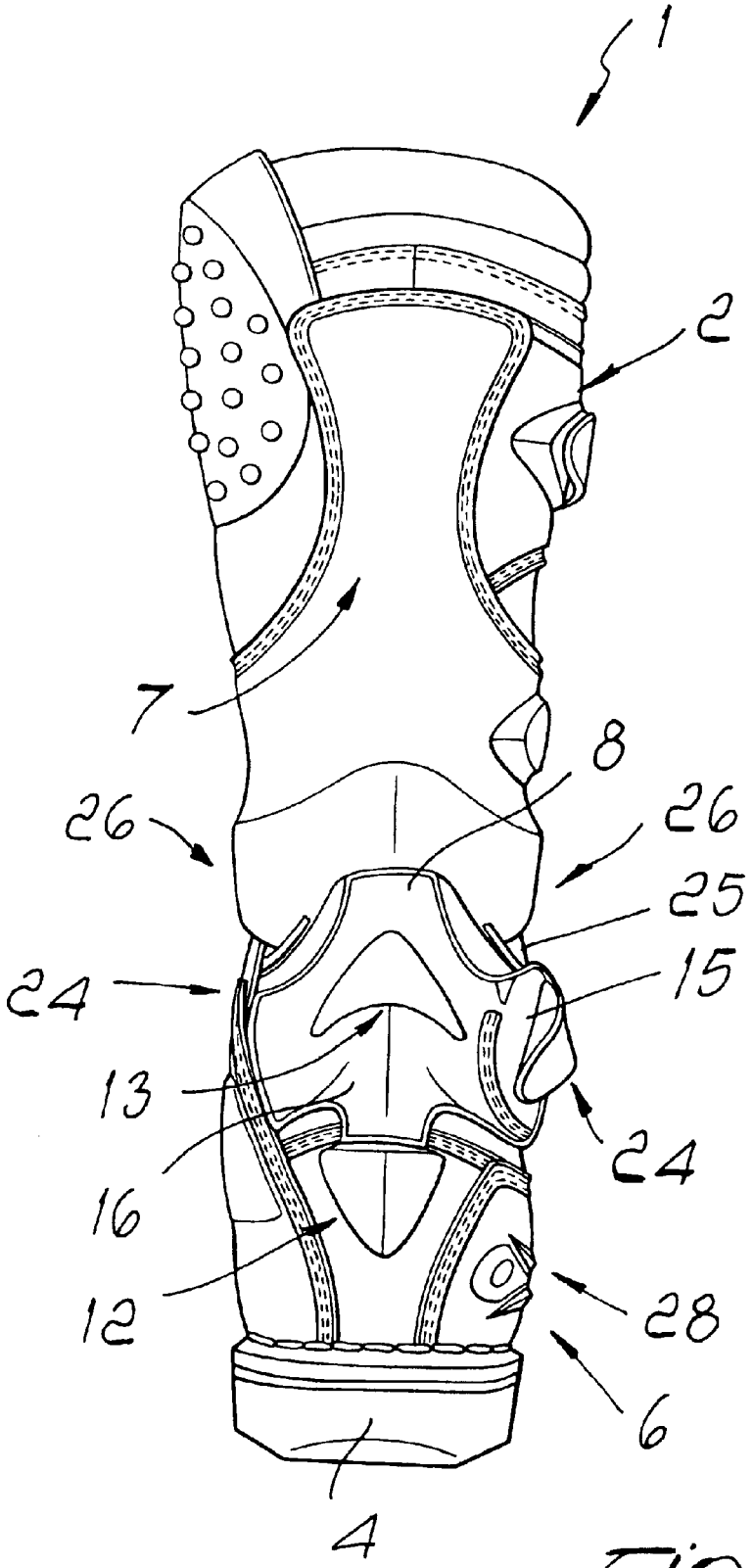
FIG. 4 is a rear view of the invention.
Figure 5:
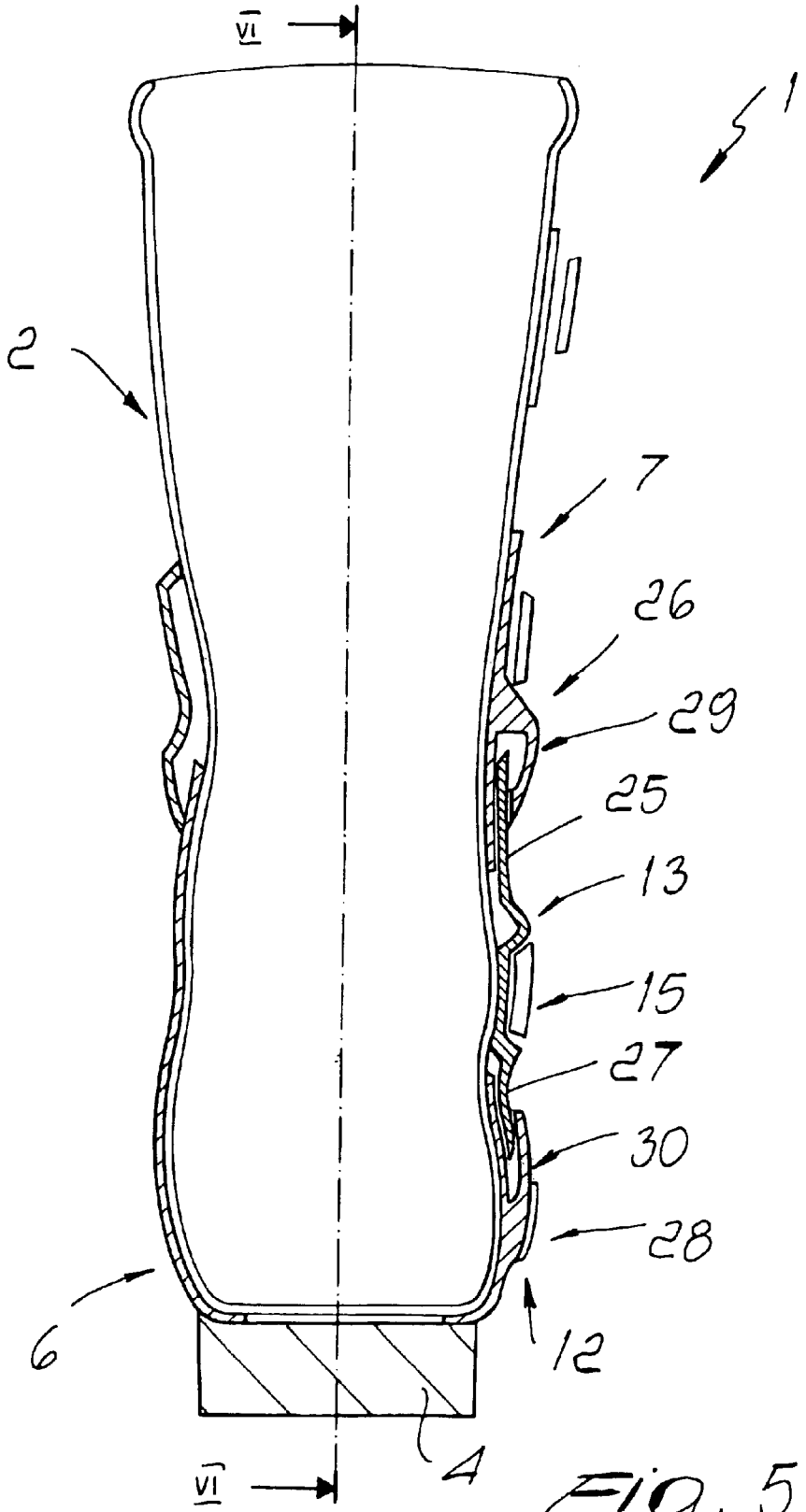
FIG. 5 is a sectional view of the invention, taken along the line V—V of FIG. 1.
Figure 6:
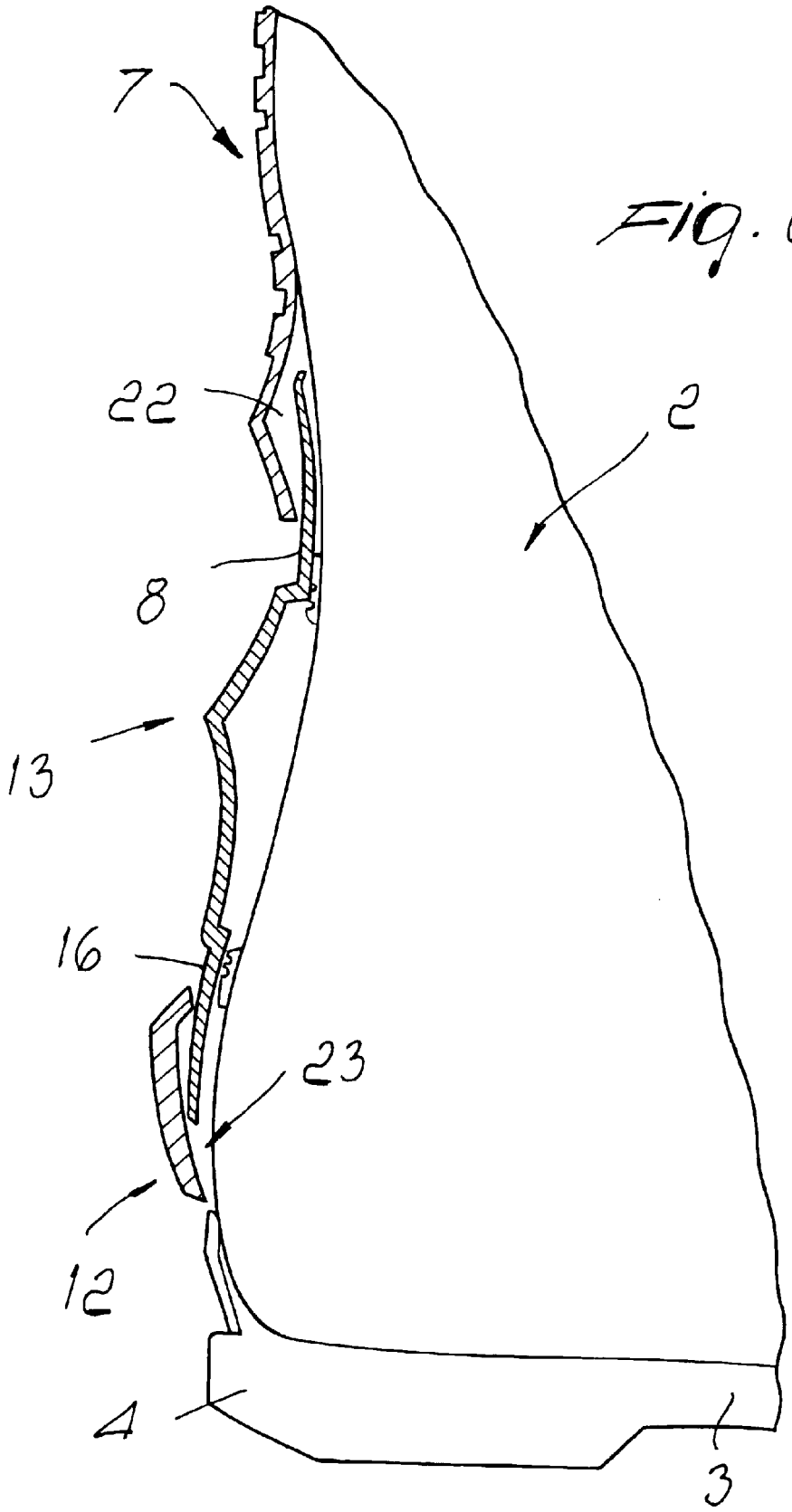
FIG. 6 is a sectional view of the invention, taken along the line VI—VI of FIG. 5.

In the examples of embodiment that follow, individual characteristics, given to specific examples, may actually be interchanged with other different characteristics that exist in other examples of embodiment.

Moreover, it is noted that anything found to be already known during the patenting process is understood not to be claimed a nd to be the subject of a disclaimer.

With reference to the figures, the reference numeral 1 designates a sports shoe, particularly for motocross, which comprises an upper 2, preferably made of cut or injection-molded soft material, optionally preformed by injection, sewn or joined by thermal bonding according to the intended shoe configuration.

A sole 3 provided with a heel 4 at the rear is associated with the upper in a lower region.

In the upper 2, which in the particular embodiment shown is shaped like a boot, the numeral 5 designates a first region that is located at the toe and the reference numeral 6 designates, at the opposite end, a second region located at the heel.

A preferably semirigid cuff 7 is monolithically associated or formed at the rear of the upper 2 and by being located above the region that corresponds to the malleoli of the foot it partially wraps around the lower part of the user's leg.

A semirigid counter 12 is associated or monolithically coupled to the upper 2 at the second region 6 and wraps around the entire heel of the user, while in an intermediate region between said counter and the overlying cuff 7 an additional semirigid element 13 is associated with the upper 2 or rigidly coupled thereto; said additional semirigid element is essentially cross-shaped and is arranged so that it has first wings that are approximately vertical and are arranged to the rear of the upper and longitudinally thereto and second wings that are approximately transverse to the upper 2, so as to wrap around the adjacent region of the leg at the rear and laterally wrap around the malleoli.

The additional semirigid element 13 therefore has, at the rear, at least one first upper tab 8, which protrudes approximately vertically toward the overlying cuff 7, and at least one second lower tab 16, which protrudes approximately vertically toward the underlying counter 12; the tabs 8,16 constitute the first wings.

Said at least one first tab and at least one second tab slidingly and freely engage first guiding means, which are formed in said cuff and said counter and are constituted by first receptacles 22 and second receptacles 23 that are formed respectively advantageously at, or crosswise, the thickness of the cuff 7 and the counter 12, i.e. at the lower and, respectively, upper border edges thereof.

The additional semirigid element 13 has advantageously, at at least one of the first tips 24 of the second wings, at least one approximately elliptical first reinforcement 15 on the outer side of the foot, suitable to constitute a protection region for the malleoli of the foot of the user.

At least one third upper tab 25 and at least one fourth lower tab 27 protrude from said at least one first reinforcement 15; said upper tab protrudes approximately vertically toward the overlying third lateral region 26 of the cuff 7 and said lower fourth tab protrudes approximately vertically toward the underlying fourth lateral region 28 of the counter 12.

Advantageously, the third tab 25 protrudes slightly obliquely along an axis A that forms an acute angle $\alpha$, considering a counterclockwise rotation as positive, with respect to an axis B that is perpendicular to the ground and passes through the first region of the malleoli.

Advantageously, the fourth tab 27 also protrudes slightly obliquely along an inclined axis A that forms an acute angle $\alpha$, considering a counterclockwise rotation as positive, with respect to a vertical axis B that is perpendicular to the ground and passes through the first region of the malleoli.

Said at least one third tab 25 and at least one fourth tab 27 engage slidingly and freely with second guiding means formed in said cuff and said counter, said guiding means being constituted by third receptacles 29 and fourth receptacles 30 formed respectively advantageously at, or crosswise, the thickness of the cuff 7 and the counter 12, i.e. at the lower and, respectively, upper border edges thereof.

The use of the invention entails that the positioning distances between the counter 12, the semirigid element 13 and the cuff 7 allow the sliding engagement of the first, second, third and fourth tabs in the first, second, third and fourth receptacles, so as to allow the foot of the user to perform a controlled forward or backward flexing motion, a controlled lateral left or right movement, or a combination thereof.

It has thus been found that the invention has achieved the intended aim and objects, since it allows the user to maintain a high level of fit, to perform correct and guided movement of the system formed by the foot and the ankle particularly during the sports practice of motocross, and at the same time to ensure effective support and protection of the foot and of the ankle.

The invention in fact has an optimum ratio between lateral and longitudinal rigidity and yielding, obtaining optimum performance even at a non-advanced user level.

The invention is of course susceptible of numerous modifications and variations, all of which are within the scope of the appended claims.

Accordingly, the third and fourth tabs and the respective third and fourth receptacles can be provided also at the inner side of the foot.

The materials used, as well as the dimensions that constitute the individual components of the invention, may of course be the most pertinent according to specific requirements.

The various means for performing certain different functions need not certainly coexist only in the illustrated embodiment but can be present per se in many embodiments, including ones that are not illustrated.

The disclosures in Italian Patent Application No. TV2002AV000106 from which this application claims priority are incorporated herein by reference.

What is claimed is:

1. A sports shoe comprising: a soft upper that is provided with a cuff and with a rear counter which are semirigid and are separately connected to said upper; an additional semirigid element that is connected to said upper in an intermediate region between said cuff and said counter; and first guiding means formed in said cuff and said counter, said additional semirigid element being provided, at the rear of the shoe and laterally thereto, with at least one first tab and at least one second tab for sliding engagement in said first guiding means.

2. The shoe of claim 1, wherein said semirigid cuff is rigidly associated to, or formed monolithically with, said upper and partially wraps around a region of the shoe that corresponds to a lower part of a leg of a user, and said semirigid counter wraps around a heel region of the shoe, said additional semirigid element is coupled to said upper in an intermediate region of the shoe between said counter and said cuff, said additional semirigid element being substantially cross-shaped so as to form first wings, which are arranged approximately vertically to a rear part of said upper and longitudinally thereto, and second wings, which are arranged approximately transversely to said upper, said additional semirigid element further wrapping around an adjacent region of the shoe corresponding to the rear of the leg of a user and laterally around a region of the shoe that corresponds to the malleoli of the user.

3. The shoe of claim 2, wherein said additional semirigid element has, at a rear part thereof, at least one upper said first tab that protrudes approximately vertically toward said overlying cuff.

4. The shoe of claim 2, wherein said additional semirigid element has, at a rear part thereof, at least one lower said second tab that protrudes approximately vertically toward the underlying counter.

5. The shoe of claim 2, wherein said first wings are constituted by said at least one first tab and said at least one second tab.

6. The shoe of claim 5, wherein said at least one first tab and said at least one second tab engage slidingly and freely with said first guiding means formed in said cuff and said counter, said first guiding means being constituted by first and second receptacles that are formed, respectively, at a thickness cross-sectional region of said cuff and said counter.

7. The shoe of claim 5, wherein said additional semirigid element has at least one first reinforcement that is approximately elliptical and is arranged at at least one of first tips of said second wings and at least on a region of the shoe that corresponds to the outer side of the foot of a user to constitute a protection region for the malleoli of the foot, at least one third upper tab being further provided that protrudes from said at least one first reinforcement approximately vertically toward an overlying third lateral region of the cuff.

8. The shoe of claim 7, comprising at least one fourth lower tab that protrudes from said at least one first reinforcement approximately vertically toward an underlying fourth lateral region of said counter.

9. The shoe of claim 8, wherein said third tab protrudes slightly obliquely along an inclined axis that forms an acute angle, considering a counterclockwise rotation as positive, with respect to a vertical axis that is perpendicular to the ground and passes through a first region of the shoe that corresponds to the malleoli of a user.

10. The shoe of claim 8, wherein said fourth tab protrudes slightly obliquely along an inclined axis that forms an acute angle, considering a counterclockwise rotation as positive, with respect to a vertical axis that is perpendicular to the ground and passes through a first region of the shoe that corresponds to the malleoli of a user.

11. The shoe of claim 10, comprising second guiding means constituted at least by third receptacles and fourth receptacles formed respectively at a thickness cross-sectional region of said cuff and said counter, said at least one third tab and said at least one fourth tab engaging slidingly and freely with said second guiding means.

* * * * *